US005216858A

United States Patent [19]

Gilmour

[11] Patent Number: 5,216,858

[45] Date of Patent: Jun. 8, 1993

[54] VERTICAL MOVEMENT CLIP AND C STUD RETAINER SYSTEM

[75] Inventor: Michael F. Gilmour, Vancouver, Wash.

[73] Assignee: Angeles Metal Systems, Commerce, Calif.

[21] Appl. No.: 705,664

[22] Filed: May 24, 1991

Related U.S. Application Data

[63] Continuation-in-part of Ser. No. 618,535, Nov. 27, 1990, abandoned, which is a continuation of Ser. No. 315,315, Feb. 24, 1989, abandoned.

[51] Int. Cl.[5] ..... E04H 1/00; E04B 1/38

[52] U.S. Cl. ..... 52/235; 52/488; 52/508; 52/665; 52/712

[58] Field of Search ..... 52/235, 712, 490, 665, 52/488, 508, 573

[56] References Cited

U.S. PATENT DOCUMENTS

| | | | |
|---|---|---|---|
| 4,121,391 | 10/1978 | Schroeder | 52/235 |
| 4,433,524 | 2/1984 | Matson | 52/665 |
| 4,570,400 | 2/1986 | Slager et al. | 52/235 |
| 4,665,662 | 5/1987 | Swanborn | 52/235 |

*Primary Examiner*—Michael Safavi
*Attorney, Agent, or Firm*—Harlan P. Huebner

[57] ABSTRACT

A vertical movement clip and C stud system wherein there is provided a generally U shaped clip secured to a building support structure having a clip web portion and two legs projecting from said web with stiffing members and a slot projecting through said clip web and into said legs with the web on one side of said slot being on an offset plane from the web on the opposite side of said slot, and a C stud adapted to interfit with said clip to allow vertical movement of said stud yet prevent outward horizontal movement of said C stud. Said C stud is adapted to receive a non-load bearing exterior finish building panel.

7 Claims, 2 Drawing Sheets

VERTICAL MOVEMENT CLIP AND C STUD RETAINER SYSTEM

This is a continuation-in-part of copending File Wrapper continuing application Ser. No. 07/618,535, filed Nov. 27, 1990, now abandoned which was a copending application Ser. No. 07/315,315, filed Feb. 24, 1989, now abandoned.

BACKGROUND OF THE INVENTION

1. Field of the Invention

This invention relates to a vertical movement clip for use in maintaining a non-load bearing exterior curtain wall to a building framework. In addition, it relates to a retainer system of the vertical movement clip in use with C shaped channeled stud members such as set forth in U.S. Pat. No. 4,235,054.

2. Description of the Prior Art

In present day architecture most large buildings utilize a support structure of a framework comprising vertical steel columns with horizontal steel beams supported therebetween, floors and a roof. The support structure is then covered on the exterior with non-load bearing exterior finish usually made up of panels or walls that are positioned one adjacent the other.

While the support structure, floors or roofs are designed to bear a calculated maximum load they also must be permitted to receive and maintain a live load due to deflection of the floors or roof and support structure. Therefore, if the non-load exterior finish panels were fixed and yielding the panels could be cracked, broken and damaged because of inflexibility.

Thus, means are needed to attach to the support structure, that will receive exterior stud members to which the exterior panels may be attached and yet allow the stud members to react to live loads and preserve the relationship of the non-load bearing exterior finish panels or walls.

Heretofore L shaped plates or clips which are only simple angle iron clips with a leg welded to a building support with the side having an elongated slot to receive a bolt or screw to secure it to a C shaped stud member were used. This bolt or screw means required a fixing of the clip or L shaped plate permanently to an exterior C shaped channeled stud. Such fixing, if the bolts were too tight would not allow for building shifting and particularly the exterior building panels that are secured to the C shaped studs.

In addition, to the above there is also a vertical movement clip covered by U.S. Pat. No. 4,121,391. This clip is again a simple L shaped clip. However, it bears improvements over the aforementioned L shaped plate in that the leg portion was actually stepped with the inner step portion spaced from the lower most surface of the leg a thickness to accommodate the thickness of a leg of a C shaped stud. Further at the inner end of the step a slot is cut through the leg and continues into the side portion normal to the plane of the leg. The slot is provided to receive a flange of a C shaped stud that is bent normal to the leg and extends therefrom.

The disadvantage of the clip in U.S. Pat. No. 4,121,391 is that it possesses little if any strength and tests have been performed to the point that it will not meet the 10% deviation criteria outlined in section 6.2 of the A.I.S.I. specification. Because of the construction the clips have a tendency to easily break from the building structure.

SUMMARY OF THE INVENTION

It is the purpose of the present invention to provide a vertical movement clip for use with a C shaped channeled stud member, which clip is secured to a building support angle and acts as a guide to receive the C shaped stud member which will have the exterior finish panel affixed to it and will prevent horizontal movement of the stud yet allow unrestrained vertical movement of the stud and in turn the exterior panel or wall.

Another object of the present invention is to provide a generally U shaped vertical movement clip of galvanized steel wherein the ends of the parallel legs of the U shaped vertical movement clip are flanged outwardly from the plane of the legs to offer strength to the legs.

A still further object of the present invention is to provide a web uniting the parallel legs of the U shaped clip. The web includes a step or portion offset from the plane of another portion of the web wherein the portions are parallel one with the other but just slightly offset. The space or offset is preferably slightly larger than the thickness of a leg of the C shaped stud member.

Another object of the present invention is to provide at the junction of the stepped portion from the other portion a slot passing through the web and into the parallel legs to receive a flange bent normal to the leg of the C shaped stud member.

A yet further object of the present invention is to provide vertical movement clips whose lengths of the steps vary to accommodate legs of various dimensions of different size C shaped studs.

Another object of the present invention is to create a system wherein a vertical movement clip is used in conjunction with a C shaped metal stud member.

These and other objections and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
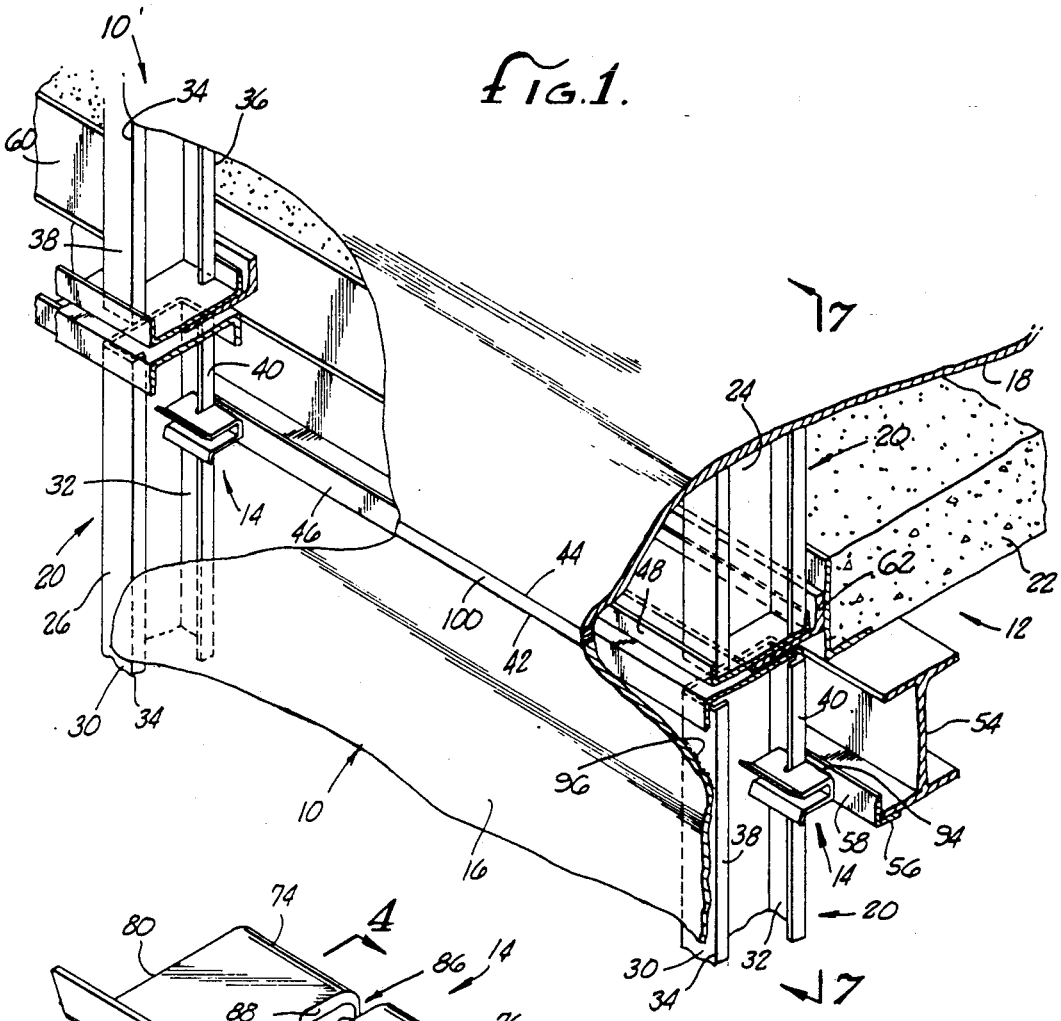
FIG. 1 is a perspective environmental view illustrating the positioning of a vertical movement clip of the present invention with respect to a building structure.
Figure 7:
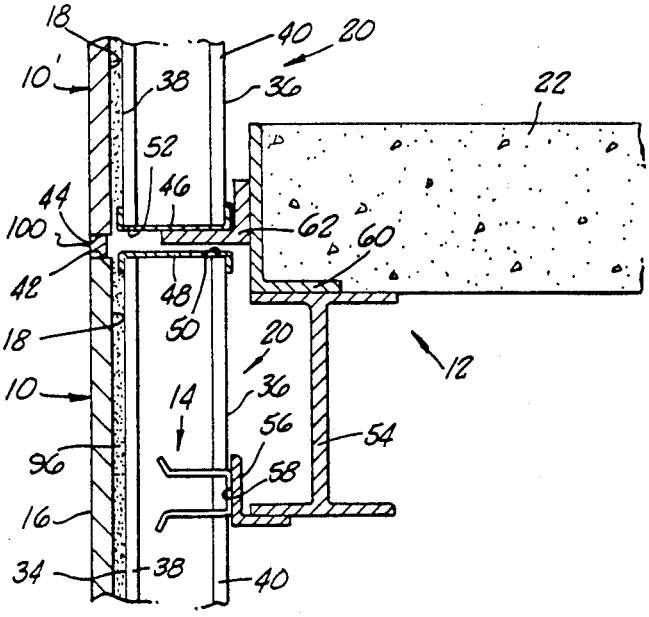
FIG. 7 is a side elevation of the clip of the present invention mounted to a steel structure support taken on line 7—7 of FIG. 1.

In FIGS. 1 and 7 there is illustrated one method of affixing exterior finish panels or walls designated 10 to the exterior of a building support structure generally designated 12 by means of vertical movement clips generally designated 14.

The finish panels or walls 10 may be of any desired material or composition and they are sometimes identified as curtain walls. Generally they come in pre cast or cut shapes with an exterior finish surface 16 and an interior surface 18 which may be finished or left rough in order to present a surface which may be affixed to a vertical C shaped channeled stud member generally designated 20. The C shaped stud member 20, as best seen in cross section in FIG. 6, or in perspective in FIG. 1 is formed from hot dipped galvanized strip steel having generally common thickness throughout and of a specific thickness gauge such as from 16-27 as prescribed by A.I.S.I.

The stud 20 may be of any desired length and is restrained by the clip 14 against horizontal movement yet is movable vertically to compensate for load bearing movement of the support structure 12 of a building. For sake of illustration a horizontal concrete floor 22 is shown in the drawings.

Stud 20 includes a web portion 24 and at ends 26 and 28 the metal is bent normal to the plane of the web 24 forming parallel legs 30 and 32, each of a lesser length than the web 24. At ends 34 and 36 of the legs 30 and 32 the metal is bent inwardly normal to the plane of each of the legs 30 and 32 forming inwardly extending flanges 38 and 40. In cross section the elongated stud 20 appears as the letter "C", thus the name C shaped stud.

Generally, there are two C shaped studs 20 for each wall or panel 10, see FIG. 1 and the length usually corresponds with the length of each panel 10, see FIGS. 1 and 7. In the illustrations of panels 10 in FIG. 1 and 7 there is an upper or top edge 42 of a lower panel 10 and a lower or bottom edge 44 of an upper panel 10'.

At least each pair of C shaped studs may include a top track 46 or bottom track 48 U shaped in cross section which clamps over the top end 50 of the lower stud or bottom end 52 respectively of the studs. The tracks extend at least the distance between a pair of the vertical C shaped studs.

Figure 5:
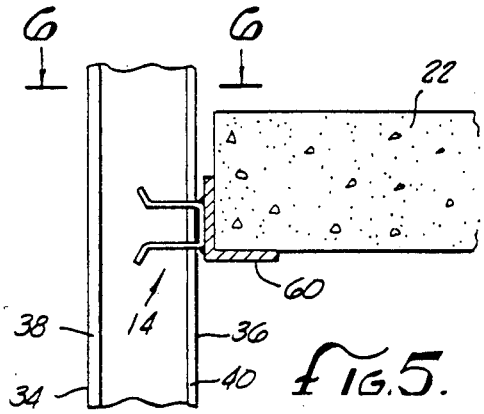
FIG. 5 is a side elevational view of the clip of the present invention mounted on a building support angle acting as a clip to maintain a C shaped stud member.
Figure 6:
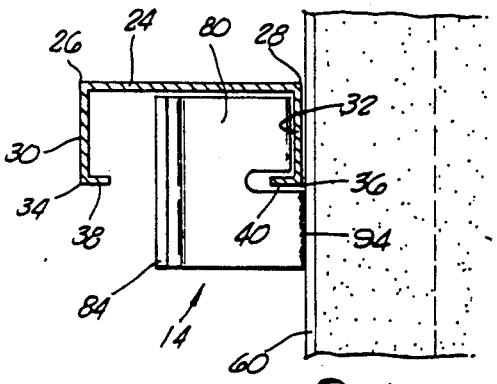
FIG. 6 is a top plan view taken on line 6—6 of FIG. 5.

The building support structure 12, as best seen in FIGS. 1, 5, 6, and 7, may take a variety of forms depending upon the size of the building as well as the load bearing characteristics desired. For sake of illustration there is the concrete floor 22 which has been poured or positioned to overlay a conventional steel I beam 54. In the illustrations the beam 54 runs along the perimeter of the building. FIGS. 5 and 6 show a floor without an I beam adjacent the peripheral edge of the building.

In FIGS. 1 and 7 there is secured to the bottom of the I beam 54 an elongated construction attachment angle 56 of a required size. One face 58 is presented to the outside of the building to which the vertical movement clip 14 is secured, to be more fully explained.

The floor 22 may also be fitted by any conventional means with a construction attachment angle 60 to which a clip 14 may be attached, FIGS. 5 and 6 or a bottom stop plate 62, FIGS. 1 and 7, may be attached. The stop plate 62 may be used to rest the bottom end 52 or the bottom track 46 of a C shaped stud.

Figure 2:
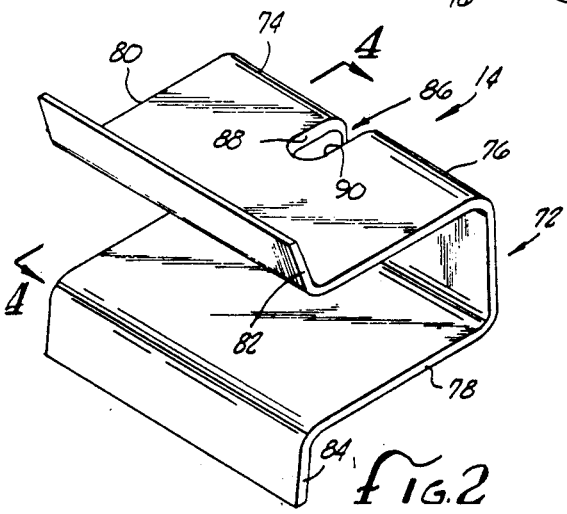
FIG. 2 is a perspective view of the vertical movement clip of the present invention.
Figure 3:
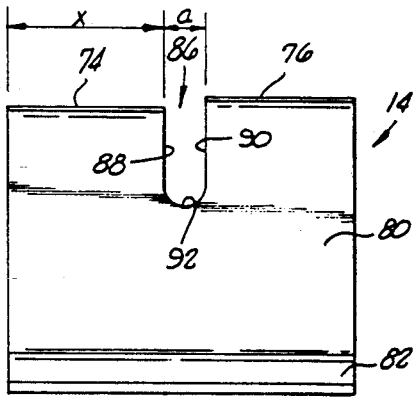
FIG. 3 is a top plan view of the vertical movement clip of the present invention.
Figure 4:
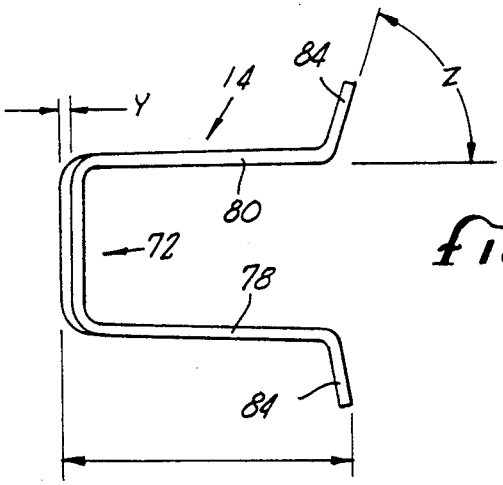
FIG. 4 is a side elevational view of the clip taken on line 4—4 of FIG. 2.

Turning now to details of the vertical movement clip 14, FIGS. 2, 3, and 5 furnish adequate illustrations. In cross section the clip 14 is generally U shaped and preferably formed from a single piece of metal. There is a bottom web portion generally designated 72. The web portion 72 extends the entire length of the clip. However, in forming the web 72 a length 74 designated by arrow x, FIG. 3, is actually formed inwardly of the plane of the remaining length 76 the width of arrows y—y, see FIG. 4. In other words, the respective lengths 74 and 76 of the web 72 are parallel but offset from each other the dimension y—y, FIG. 4. Together both lengths 74 and 76 form the web 72.

The dimension y—y is slightly greater than the thickness of the leg portions 30 and 32 of clip 14 to allow one of the legs 32 to interfit between the attachment angle 60 and the web 72.

Projecting from web 72 are spaced apart parallel legs 78 and 80. The legs 78 and 80 are preferably the same length as the base or web 72.

As can best be seen in FIG. 2, each leg 78 and 80 includes an end stiffening portion or bend 82 and 84 each of which is canted at an angle Z outwardly of the plane of the legs 78 and 80. The inventor has found that an angle Z of between 45° and 90° is satisfactory to the excellent performance of the clip 14. However the optimum angle of 50° is considered the best for overall strength and usefulness of the clip.

The clip 14 further includes a slot generally designated 86 which extends through the web 72 and into the legs 78 and 80, see FIGS. 2 and 3. The slot 86, includes parallel walls 88 and 90 and end wall 92. The width a of a slot 86 is wider than the thickness of the steel metal gauge of the flange 40 of the C stud 20 as shown in FIG. 6. As a result of the slot 86 being wider than the flange 40, the slot 86 is able to move unrestrained by the flange thereby permitting movement of the slots 86 relative to the flange 40. Practically the width and length of the slot 86 is not critical as long as there is sufficient play and space between it and the flange 40.

In operation, the vertical movement clip 14 or a plurality of them are welded to the angle iron 56 or I beam 54 at 94. The weld 94 preferably extends along the remaining length 76 of the clip 14. In some cases a second weld is provided at the lower part of the clip 14 at the bend between the web 72 and the leg 78.

With the clips 14 appropriately secured to the building support structure 12 the final exterior curtain sections 16 may be positioned. When it is known the exterior dimension of each of the non-load bearing exterior finish walls 16, two or more C shaped channeled studs 20 are cut to the proper length.

Each stud 20 is then permanently secured to the finish panel 10 such as by conventional adhesive 96 which extends from the inner surface 18 of the wall 16 to the leg 30 of the clip 14.

Once the wall section 16 is mounted to the C studs 20 the studs may be inserted. As can be seen in FIG. 1, 5, 6, and 7 and C studs 20 are inserted behind the clip 14 by passing the leg 32 between the building structure 12 and the length 74 of the web 72 in the raised or off set space y—y. The flange 40, see FIG. 6, will then slide into the slot 86.

As the C stud 20 passes between the building support structure 12 and the clip 14 it is moved down to a point such as seen in FIG. 7, where the bottom track 46 will abut the stop plate 62.

Additional exterior finish panels 10' are then installed under, around or on top of the panel 10. The usual practice is that once the panels 10 and 10' are in place appropriate conventional chalking or expansion type joints 100 are inserted between the panels to finish the building.

As can be seen from the drawings and determined from the specification with the clip construction 14 there is a horizontal restraint on the C studs with the flange 40 engaging either of the sides 88–90 of the slot 86 which act as horizontal stops. However, because there is no fixing of the C stud 20 the clip 14 and C stud and the finish panel 10 are allowed vertical sliding movement depending upon the deflection of the floors or roof support structure of the building. In other words the leg 32 will slide between the attachment angle 60 and length 74 of the clip 14.

Independent testing on the vertical movement clips 14 has been conducted to determine pull rate. In other words how much force is necessary to buckle the legs 78 and 80 of the clip 14 or to crack the weld 96. Due to the structure of the clip 14 there are of course two legs 78 and 80 which when combined with the opposed angle stiffing end portions 82 and 84 all A.I.S.I. requirements are met.

The tests conducted on the clips 14 are pull tests which are the closest to simulate actual weigh conditions of the finish wall panels 10 and 10' and C stud 20 combination. In other words the panels 10 of the buildings are always being urged or pulled outward of the building with the leg 32 of the C stud 20 pressing against the length 74. With the double legs 78 and 80 as well as the strengthening or stiffening ends 82 and 84 a pull force in the neighborhood of 900 lbs. pull rate is achieved. Such pull rate easily exceeds the A.I.S.I. standards as well as the pull rate of prior art structures.

While the explanation of the C shaped channeled stud 20 has been confined to one size and or steel gauge it must be realized that the stud 20 may be of various steel gauges as used in the industry as well as elongated dimensions. Generally, there are three sized of C studs 20. The sizes will vary the leg lengths, flange lengths and gauge of the steel.

In such a case where there are various size C studs it may be necessary to provide vertical movement clips 14 of various dimensions to accommodate the respective C studs.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. In a vertical movement clip for securement to a building support structure, said clip being adapted to receive an elongated C shaped channel stud to allow vertical movement yet restrain horizontal movement of said clip, an exterior non-load bearing finish panel secured to said C shaped stud wherein the clip includes an elongated planar clip web portion of a predetermined length having an upper and lower edge with a slot cut through said clip web between said upper and lower edges, said slot having opposed parallel sides and said clip web on one side of said slot is upset forming a plane there along which is offset inwardly from the plane of said clip web on said opposite side of said slot and there is a space between said structure and said offset, and said C shaped channel stud includes a pair of legs spaced from each other by a stud web with flanges extending inwardly toward each other from said legs, the improvement including:

a pair of generally parallel legs having planes extending from the edges of said clip web and normal thereto, each of said legs includes stiffening means, and said slot extends into each of said legs whereby a flange of said elongated C shaped channel stud is positioned in said slot and a leg of said C stud interfits in the space created by said offset portion of said clip web and said structure to allow vertical sliding movement of said C shaped channel stud yet restrain horizontal movement of said C stud wherein said flange is stopped against either side of said slot; and said slot has a width dimension greater than the thickness of said flange to allow play for said flange between the sides thereof and to prevent binding of any portion of said flange in said slot upon vertical movement of said clip, and;

said stiffening means includes end portions of a length corresponding to the length of said legs and said web and wherein said end portions are bent at an angle relative to the plane of each of said legs.

2. In a vertical movement clip of claim 1 wherein the angle of said end portions each range from 45° to 90° from the plane of said legs.

3. In a vertical movement clip of claim 2 wherein the optimum angle is approximately 50°.

4. In a vertical movement clip of claim 1 wherein said end portions are bent at opposed angles each one from the other.

5. A vertical movement clip and C shaped metallic stud system adapted to prevent horizontal movement of said C shaped stud yet yieldably allow vertical sliding movement of said C shaped stud, said C shaped stud includes a stud web, a pair of parallel legs projecting from said stud web and flanges bent toward each other from said legs normal to the plane of said legs, one of said legs is adapted to fixedly receive an exterior non-load bearing building finish panel, and wherein said clip includes an elongated planar clip web portion of a predetermined length and a predetermined width with a slot cut through the width of said clip web and said clip web on a first side of said slot is upset forming a plane therealong which is offset inwardly from the plane of a second side of said clip web on the other side of said slot, and said second side is permanently secured to a building support structure, the improvement comprising:

a pair of generally parallel legs having planes extending normal to the plane of said clip web, said legs each including stiffening means having end portions of a length corresponding to the length of said legs and said web wherein said end portions are bent at opposed angles each one from the other relative to the plane of each leg, said slot of said clip web extending inwardly into each of said legs; and said first side of said clip web being spaced from said building support structure whereby the leg of said C stud opposite said leg fixedly receiving said finish panel is received within said space and said flange of said leg being of a thickness less than the width of said slot is received within said slot.

6. In a system of claim 5 wherein the angle of each of said stiffening portions each range from 45° to 90° from the plane of said legs.

7. In a system of claim 5 wherein the optimum angle of each of said stiffening portions is approximately 50°.

* * * * *